US009817329B2

(12) United States Patent
Kimura et al.

(10) Patent No.: US 9,817,329 B2
(45) Date of Patent: Nov. 14, 2017

(54) CHARGING DEVICE INCLUDING CLEANING MEMBER AND IMAGE FORMING APPARATUS

(71) Applicant: FUJI XEROX CO., LTD., Tokyo (JP)

(72) Inventors: Akiko Kimura, Kanagawa (JP); Sadao Okano, Kanagawa (JP); Yasuo Takayama, Kanagawa (JP); Yusuke Kitagawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/242,878

(22) Filed: Aug. 22, 2016

(65) Prior Publication Data

US 2017/0205725 A1 Jul. 20, 2017

(30) Foreign Application Priority Data

Jan. 19, 2016 (JP) ..... 2016-007852
Jan. 19, 2016 (JP) ..... 2016-007853

(51) Int. Cl.
*G03G 15/02* (2006.01)

(52) U.S. Cl.
CPC ..... *G03G 15/0258* (2013.01)

(58) Field of Classification Search
CPC ..... G03G 15/0258
USPC ..... 399/100, 115
See application file for complete search history.

(56) References Cited

U.S. PATENT DOCUMENTS

2012/0257905 A1* 10/2012 Ichikawa ..... G03G 15/0291 399/100

FOREIGN PATENT DOCUMENTS

JP 05-281839 A 10/1993
JP 10-090979 A 4/1998

* cited by examiner

*Primary Examiner* — Billy Lactaoen
(74) *Attorney, Agent, or Firm* — Sughrue Mion, PLLC

(57) ABSTRACT

A charging device includes a first cleaning member, a first electrode, a second cleaning member, a second electrode, and a movable body. The first cleaning member moves in one direction. The first electrode is cleaned by the first cleaning member moving in the one direction. The second cleaning member moves in the one direction together with the first cleaning member and moves so that a downstream end portion thereof, which is located downstream in the one direction, serves as a leading portion and an upstream end portion thereof comes after the downstream end portion. The second electrode includes a first region and a second region. The first region is cleaned by the second cleaning member moving in the one direction. The second region is located downstream in comparison with the first region in the one direction.

6 Claims, 12 Drawing Sheets

CHARGING DEVICE INCLUDING CLEANING MEMBER AND IMAGE FORMING APPARATUS

CROSS-REFERENCE TO RELATED APPLICATIONS

This application is based on and claims priority under 35 USC 119 from Japanese Patent Application Nos. 2016-007852and 2016-007853 both filed Jan. 19,2016.

BACKGROUND

Technical Field

The present invention relates to a charging device and an image forming apparatus.

SUMMARY

According to an aspect of the invention, a charging device includes a first cleaning member, a first electrode, a second cleaning member, a second electrode, and a movable body. The first cleaning member moves in one direction. The first electrode is cleaned by the first cleaning member moving in the one direction. The second cleaning member moves in the one direction together with the first cleaning member and moves so that a downstream end portion thereof, which is located downstream in the one direction, serves as a leading portion and an upstream end portion thereof comes after the downstream end portion. The second electrode includes a first region and a second region. The first region is cleaned by the second cleaning member moving in the one direction. The second region is located downstream in comparison with the first region in the one direction and applies, to the second cleaning member, a drag force higher than a drag force acting on the second cleaning member when the second cleaning member passes on the first region. The first cleaning member and the second cleaning member are attached to the movable body. The movable body moves in the one direction to come into contact with a predetermined position before the upstream end portion of the second cleaning member reaches the second region so as to receive a driving force from the predetermined position and separate the first cleaning member from the first electrode by using the driving force.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described in detail with reference to the accompanying drawings.

Figure 1:
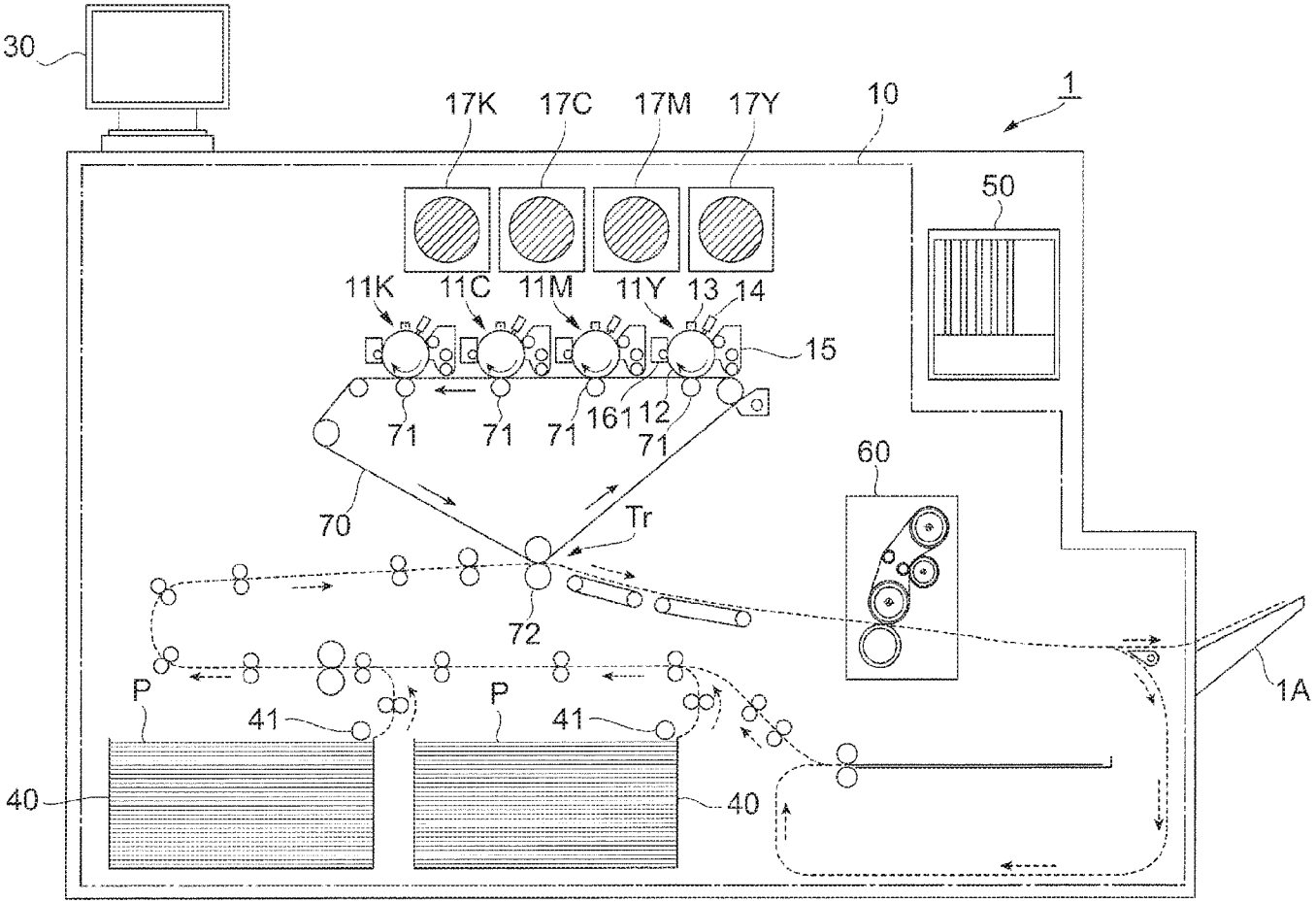
FIG. 1 is a view illustrating an exemplary configuration of an image forming apparatus according to an exemplary embodiment of the present invention.

FIG. 1 is a view illustrating an exemplary configuration of an image forming apparatus 1 according to an exemplary embodiment of the present invention.

The image forming apparatus 1 illustrated in FIG. 1 is a so-called tandem type color printer, and includes an image forming device 10 that forms an image based on image data. Further, the image forming apparatus 1 is provided with a main controller 50.

The main controller 50 is configured with a program-controlled central processing unit (CPU), and performs, for example, an operation control of each device and each functional unit provided in the image forming apparatus 1, a communication with a personal computer, etc., or a processing of image data.

Further, the image forming apparatus 1 is provided with a user interface unit 30 that receives an operation input from a user or displays various kinds of information to a user.

The image forming device 10, as an example of an image forming device, is a functional unit that forms an image by using, for example, an electrophotographic method, and includes four image forming units which include a yellow (Y) image forming unit 11Y, a magenta (M) image forming unit 11M, a cyan (C) image forming unit 11C, and a black (K) image forming unit 11K.

In the following descriptions, the respective image forming units will be referred to as "image forming units 11" unless they should be expressed to be particularly discriminated from each other.

The image forming unit 11Y, the image forming unit 11M, the image forming unit 11C, and the image forming unit 11K form a yellow toner image, a magenta toner image, a cyan toner image, and a black toner image, respectively.

The image forming units 11 are provided with photoconductor drums 12, respectively, as an example of image carriers. Each photoconductor drum 12 is formed in a cylindrical shape, and holds a toner image formed on the outer circumferential surface thereof. More specifically, in the present exemplary embodiment, an electrostatic latent image is formed on the surface of the photoconductor drum 12, and subsequently, a development is carried out by a toner. Therefore, a toner image is formed on the surface of the photoconductor drum 12, and the toner image is temporarily held by the photoconductor drum 12.

Further, the image forming units 11 are provided with charging devices 13, respectively, that charge the surfaces of the photoconductor drums 12, and exposure devices 14, respectively, that expose the photoconductor drums 12 charged by the charging devices 13 based on the image data.

Further, the image forming units 11 are provided with developing devices 15, respectively, that develop the electrostatic latent images formed on the photoconductor drums 12 by using color toners, and cleaners 161, respectively, that clean the surfaces of the photoconductor drums 12 after the transfer.

In addition, the image forming units 11 have the same configuration, except for the toners accommodated in the image developing devices 15.

Further, the image forming device 10 is provided with an intermediate transfer belt 70 to which the color toner images formed on the photoconductor drums 12 of the image forming units 11 are transferred, and primary transfer rolls 71 that transfer (primarily transfer) the color toner images formed by the image forming units 11 to the intermediate transfer belt 70.

Further, the image forming device 10 is provided with secondary transfer rolls 72 that transfer (secondarily transfer) the color toner images superposed and transferred onto the intermediate transfer belt 70, to a recording material P such as a paper sheet at one time. Further, the image forming device 10 is provided with a fixing device 60 that fixes the secondarily transferred color toner images onto the recording material P.

In the present exemplary embodiment, hereinafter, the region where the secondary transfer rolls 72 are disposed and the color toner images on the intermediate transfer belt 70 are secondarily transferred to the recording material P will be referred to as a secondary transfer region Tr.

The operation of the image forming apparatus 1 will be described.

When forming an image, the image forming units 11 form black, cyan, magenta, and yellow color toner images, respectively, through the electrophotographic processes.

The color toner images formed by the respective image forming units 11 are sequentially and primarily transferred to the intermediate transfer belt 70 by the primary transfer rolls 71, and toner images with the color toners superposed thereon are formed on the intermediate transfer belt 70.

The toner images on the intermediate transfer belt 70 are transported, with the movement of the intermediate transfer belt 70, to the secondary transfer region Tr where the secondary transfer rolls 72 are disposed.

In a recording material transport system, the recording material P, which has been dispensed by a dispensing roll 41 from a recording material accommodating container 40, is transported along a transport path and then reaches the secondary transfer region Tr.

In the secondary transfer region Tr, the toner images on the intermediate transfer belt 70 are secondarily transferred to the recording material P at one time by a transfer electric field formed by the secondary transfer rolls 72.

Thereafter, the recording material P to which the toner images have been transferred is separated from the intermediate transfer belt 70, and transported to the fixing device 60 along the transport path.

The toner images on the recording material P transported to the fixing device 60 are fixed onto the recording material P by the fixing device 60. Thereafter, the recording material P is transported to a recording material discharge unit 1A.

Figure 2:
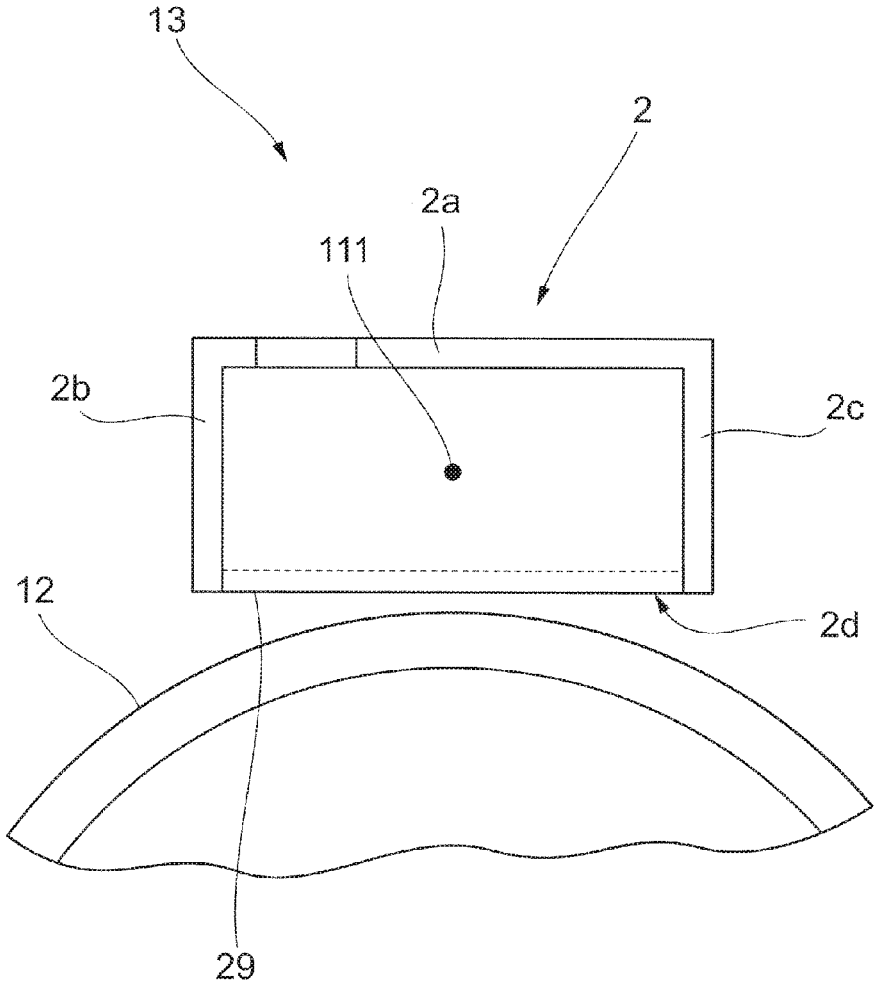
FIG. 2 is an enlarged view of a charging device.
Figure 3:
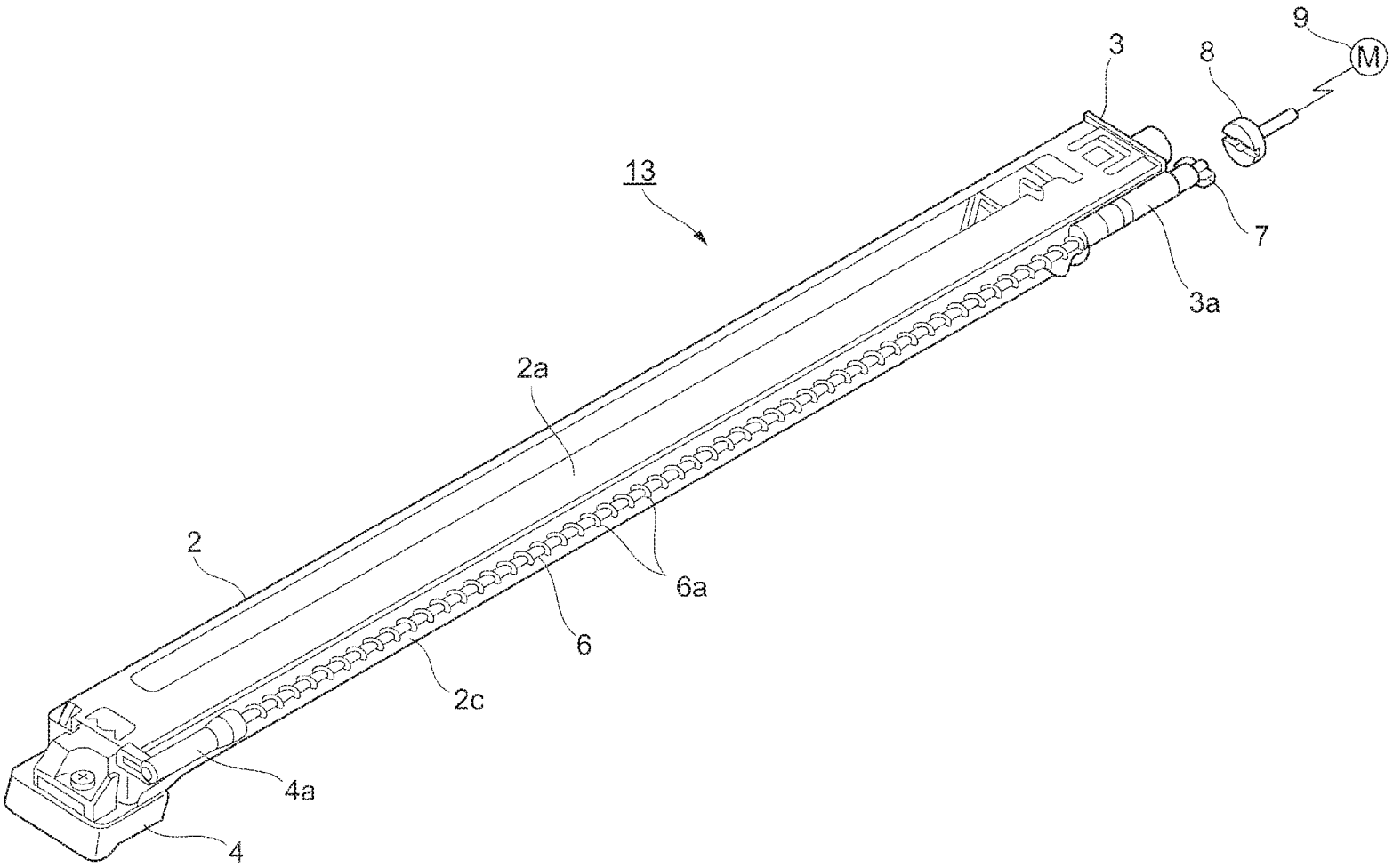
FIG. 3 is a perspective view of the charging device.

FIG. 2 is an enlarged view of the charging device 13. FIG. 3 is a perspective view of the charging device 13. The charging device 13 will be described with reference to FIGS. 2 and 3.

As illustrated in FIG. 2, the charging device 13 is provided with a shield electrode 2 that extends in the front and rear direction of the image forming apparatus 1 (see FIG. 1) (in the depth direction of the image forming apparatus 1, that is, in the direction orthogonal to the paper surface in FIG. 2), and is opened at the side thereof directed toward the photoconductor drum 12. In other words, the charging device 13 is provided with the shield electrode 2 that extends along the axial direction of the photoconductor drum 12.

The shield electrode 2 is made of a metallic material. In addition, the shield electrode 2 includes a plate-shaped upper wall portion 2*a* that extends in the front and rear direction of the image forming apparatus 1, and a plate-shaped left wall portion 2*b* and a plate-shaped right wall portion 2*c* that extend downward from the left and right opposite sides of the upper wall portion 2*a*, respectively.

As illustrated in FIG. 3, a rear end block 3 is attached to the rear end (one end portion) of the shield electrode 2, and a front end block 4 is attached to the front end (the other end portion) of the shield electrode 2.

Cylindrical shaft support portions 3*a* and 4*a* are provided on the rear end block 3 and the front end block 4 (right side top portions of the rear end block 3 and the front end block 4 in FIG. 3), respectively, to extend in the front and rear direction.

In the present exemplary embodiment, a shaft 6 extending in the front and rear direction is rotatably supported by the shaft support portions 3*a* and 4*a*. As an example of a rotating member, the shaft 6 is provided with a spiral protrusion portion (male thread) 6*a* on the outer circumferential surface thereof.

The rear end portion of the shaft 6 passes through the shaft support portion 3*a* and extends rearward, and a driven coupling 7 is attached to the rear end portion of the shaft 6. The driven coupling 7 is connected to a driving coupling 8 provided at the main body side of the image forming apparatus 1.

In the present exemplary embodiment, when the driven coupling 7 receives a driving force from the driving coupling 8, the shaft 6 circumferentially rotates.

As illustrated in FIG. 2, a wire electrode 111 is provided inside the shield electrode 2.

As an example of a first electrode, the wire electrode 111 is disposed to face the outer circumferential surface of the photoconductor drum 12 and follow the axial direction of the photoconductor drum 12.

In addition, the wire electrode 111 includes a wire member. One end portion of the wire electrode 111 in the front and rear direction is fixed to the front end block 4 (see FIG. 3), and the other end portion thereof is fixed to the rear end block 3.

In addition, as illustrated in FIG. 2, a grid electrode 29 is provided in an opening 2*d* of the shield electrode 2.

As an example of a second electrode, the grid electrode 29 is disposed to extend in the front and rear direction (the axial direction of the photoconductor drum 12). In addition, the grid electrode 29 is made of a metallic material in a thin-film (plate) shape.

The grid electrode 29 includes plural through holes, and the portion where the plural through holes is formed has a mesh shape. In addition, the grid electrode 29 is supported by the front end block 4 (see FIG. 3) and the rear end block 3.

The grid electrode 29 is longitudinally tensioned by the front end block 4 and the rear end block 3, and a tension force is applied to the grid electrode 29.

In the present exemplary embodiment, when a voltage is applied between the wire electrode 111 and the shield electrode 2, and between the wire electrode 111 and the grid electrode 29. Thus, a potential difference occurs between the wire electrode 111 and the shield electrode 2, and a potential difference occurs between the wire electrode 111 and the grid electrode 29. Therefore, electrons are emitted from the wire electrode 111, and the surface of the photoconductor drum 12 is charged.

Figure 4:
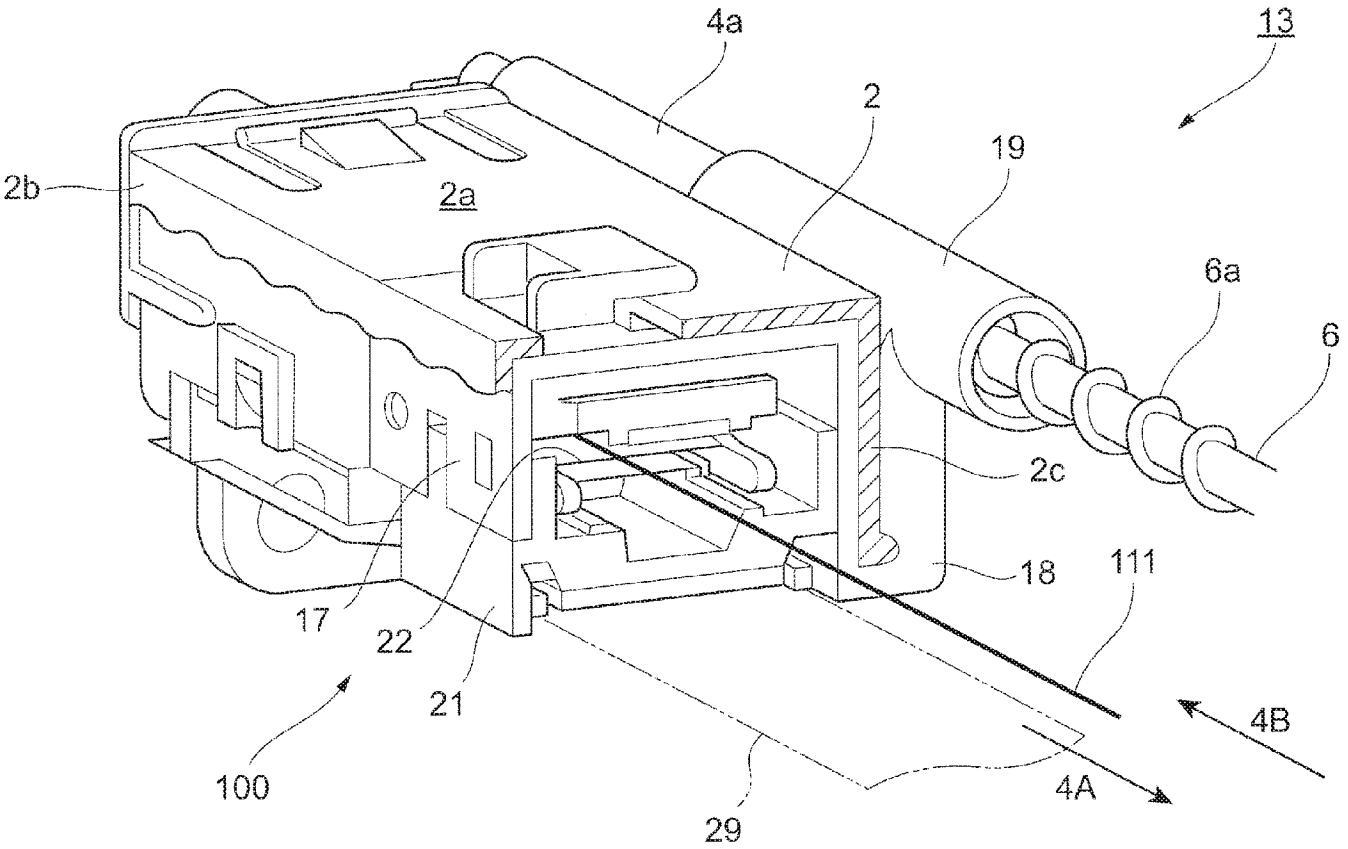
FIG. 4 is a view illustrating an internal structure of the charging device.
Figure 5:
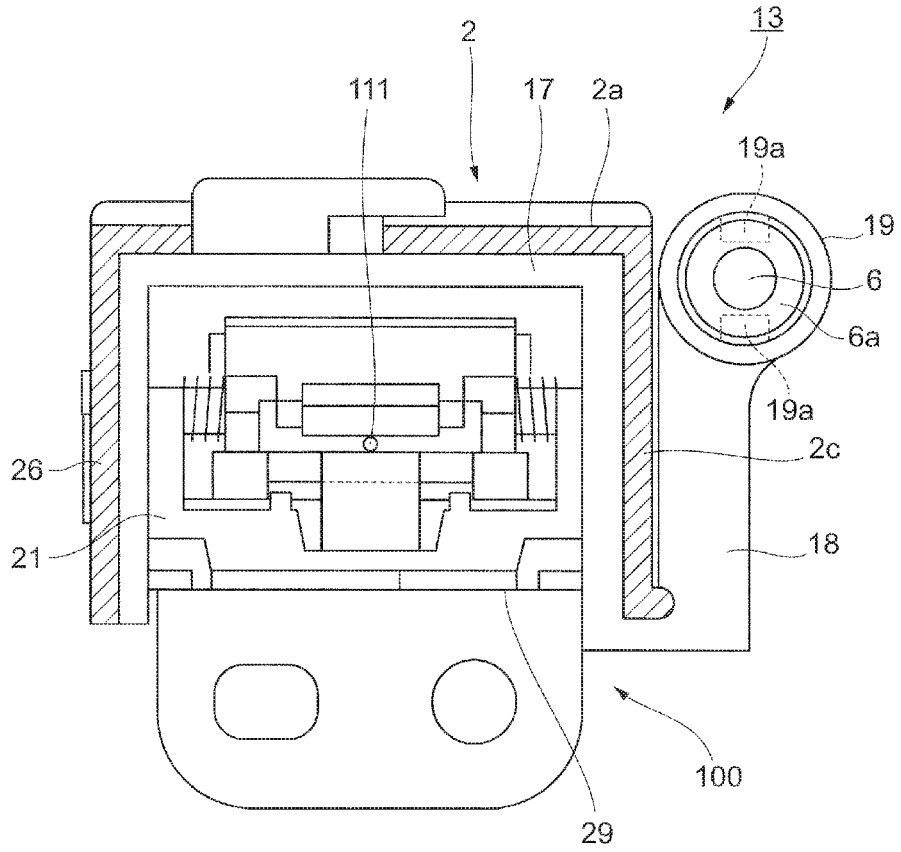
FIG. 5 is a cross-sectional view of the charging device taken along the direction orthogonal to the front and rear direction.
Figure 6:
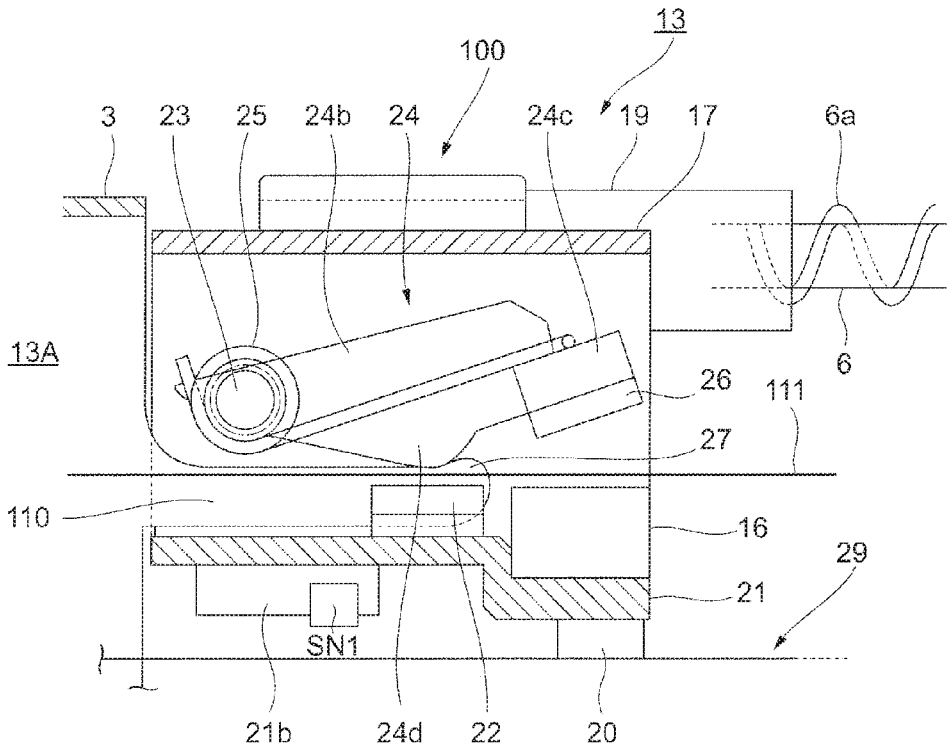
FIG. 6 is a cross-sectional view of the charging device taken along the front and rear direction.

FIG. 4 is a view illustrating an internal structure of the charging device 13. FIG. 5 is a cross-sectional view of the charging device 13 taken along the direction orthogonal to the front and rear direction. FIG. 6 is a cross-sectional view of the charging device 13 taken along the front and rear direction.

As illustrated in FIG. 4, in the present exemplary embodiment, a movable body 100 is provided to move along the wire electrode 111 (along the front and rear direction).

The movable body 100 is disposed between the shield electrode 2 and the grid electrode 29. In addition, the movable body 100 includes an upper slider frame 17 and a lower slider frame 21.

Further, the movable body 100 is provided with a cylindrical shaft penetration portion 19 through which the shaft 6 penetrates, and a connecting portion 18 that connects the shaft penetration portion 19 and the upper slider frame 17 to each other.

As illustrated in FIG. 5, pressed portions 19*a* are provided to protrude from the inner circumferential surface of the shaft penetration portion 19 and fit into the protrusion portion 6*a*.

In the present exemplary embodiment, when the shaft 6 rotates, the pressed portions 19*a* are pressed by the protrusion portion 6*a*. Therefore, the movable body 100 moves along the front and rear direction (along the longitudinal direction of the shaft 6).

FIG. 4 illustrates a state in which the movable body 100 is located at a home position.

In this state, when the shaft 6 rotates in one direction, the movable body 100 moves in the direction indicated by the arrow 4A in FIG. 4. In addition, when the shaft 6 rotates in the reverse direction, the movable body 100 moves in the direction indicated by the arrow 4B in FIG. 4B.

In the present exemplary embodiment, the wire electrode 111 and the grid electrode 29 are cleaned by the movement of the movable body 100 in the direction indicated by the arrow 4A and the movement of the movable body 100 in the direction indicated by the arrow 4B.

As illustrated in FIG. 6, a lower electrode cleaner 16 is provided inside the movable body 100 to clean the wire electrode 111 from the lower side. The lower electrode cleaner 16 is supported by the lower slider frame 21 from the lower side.

Further, the movable body 100 is provided with a grid cleaner 20 as an example of a second cleaning member. The grid cleaner 20 is in contact with the grid electrode 29 and cleans the grid electrode 29. The grid cleaner 20 is configured with, for example, a so-called brush-shaped member made by implanting cleaning bristles into a basic fabric. In addition, the grid cleaner 20 is not limited to the brush shape, and may have other shapes such as a fabric shape.

As illustrated in FIG. 6, the movable body 100 is provided with a lower wire cleaner 22 that is disposed to face the wire electrode 111.

In the present exemplary embodiment, as illustrated in FIG. 6, the lower electrode cleaner 16 and the lower wire cleaner 22 are spaced apart from the wire electrode 111 in the state in which the movable body 100 is located at the home position as a reference position.

In addition, a plate-shaped detection target 21*b* is provided on the bottom surface of the lower slider frame 21 to extend downward therefrom. In addition, a sensor SN1 is disposed at the main body 13A side of the charging device 13 to detect the detection target 21*b*. The sensor SN1 is provided at the home position, and when the sensor SN1 detects the detection target 21*b*, it is detected that the movable body 100 is located at the home position.

In addition, a shaft portion 23 is provided inside the movable body 100 to extend along the direction orthogonal to the front and rear direction. An upper cleaner support body 24 is supported by the shaft portion 23.

The upper cleaner support body 24 is provided with a pair of arm plate portions 24*b* that is rotatably supported by the shaft portion 23 (FIG. 6 illustrates only one arm plate portion 24*b*). One arm plate portion 24*b* is supported by one end portion of the shaft portion 23, and the other arm plate portion 24*b* is supported by the other end portion of the shaft portion 23.

Further, the upper cleaner support body 24 is provided with a cleaner support portion 24*c* that is attached to the tip ends of the pair of arm plate portions 24*b* and extends in the direction orthogonal to the front and rear direction.

An upper wire cleaner 26 is attached to the bottom surface of the cleaner support portion 24*c*.

The upper wire cleaner 26, as an example of a first cleaning member, comes into contact with the wire electrode 111 from the upper side of the wire electrode 111, and cleans the wire electrode 111.

A plate protrusion portion 24*d* is provided at the lower side of the arm plate portion 24*b* to protrude downward.

In addition, a block protrusion portion 110 is provided in the rear end block 3 (at the main body 13A side of the charging device 13) to protrude toward the front end block 4 (see FIG. 3). An upper protrusion portion 27 is provided at the tip end of the block protrusion portion 110 in the protruding direction thereof to protrude upward.

In the present exemplary embodiment, a screw spring 25 is provided to rotate the upper cleaner support body 24 clockwise about the shaft portion 23 in FIG. 6 and press the upper wire cleaner 26 against the wire electrode 111.

Figure 7:
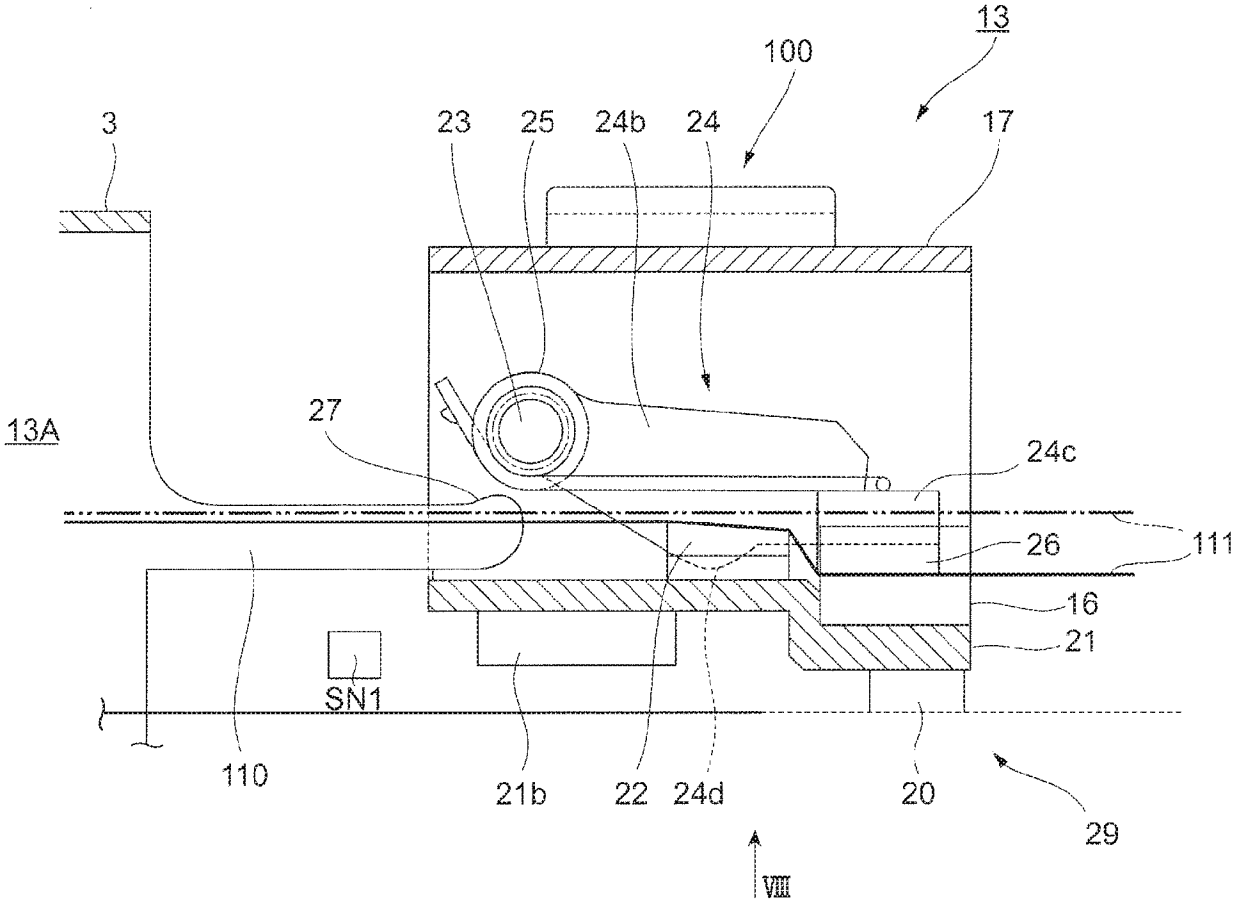
FIG. 7 is a view illustrating a state after a movable body moves forward.

FIG. 7 is a view illustrating a state after the movable body 100 moves forward. In other words, FIG. 7 is a view illustrating a state after the movable body 100 moves to the front end block 4 side (see FIG. 3).

In the present exemplary embodiment, when a motor 9 (see FIG. 3) is driven, the movable body 100 moves forward (to the front end block 4 side). Therefore, as illustrated in FIG. 7, the plate protrusion portion 24*d* moves further forward than the upper protrusion portion 27, and the upper cleaner support body 24 rotates clockwise about the shaft portion 23.

When the upper cleaner support body 24 rotates clockwise, the upper wire cleaner 26 is pressed against the wire electrode 111 from the upper side of the wire electrode 111.

When the upper wire cleaner 26 is pressed against the wire electrode 111, the wire electrode 111 moves downward. Therefore, the wire electrode 111 is pressed by the lower electrode cleaner 16 and the lower wire cleaner 22.

In the present exemplary embodiment, the movable body 100 moves in the front and rear direction in the state in which the upper wire cleaner 26, the lower electrode cleaner 16, and the lower wire cleaner 22 are pressed against the wire electrode 111 and in the state in which the grid cleaner 20 is pressed against the grid electrode 29.

Therefore, the wire electrode 111 and the grid electrode 29 are cleaned. After the cleaning of the wire electrode 111 and the grid electrode 29 is ended, the movable body 100 returns to the home position.

In other words, in the present exemplary embodiment, discharge products are attached to the wire electrode 111 and the grid electrode 29. In the present exemplary embodiment, when the movable body 100 moves in the front and rear direction, the discharge products are removed by the upper wire cleaner 26, the lower electrode cleaner 16, the lower wire cleaner 22, and the grid cleaner 20.

Figure 8:
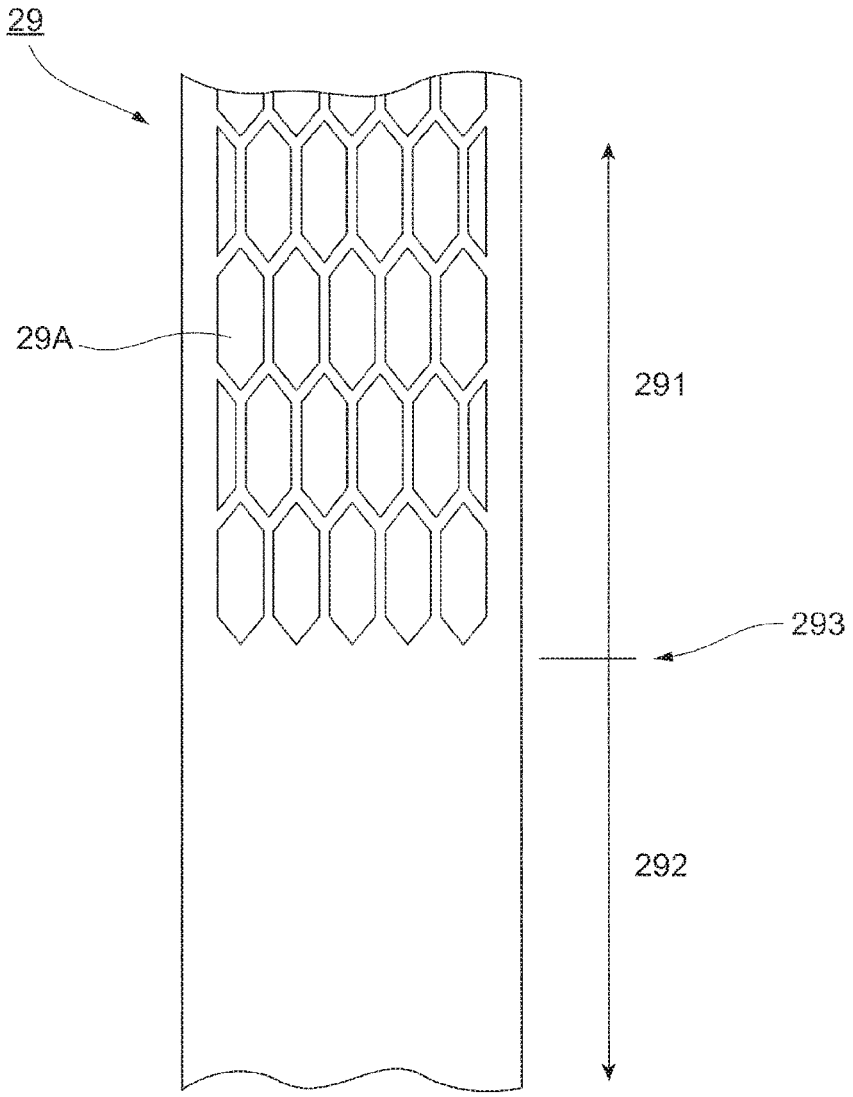
FIG. 8 is a view illustrating a grid electrode when viewed in the direction of the arrow VIII in FIG. 7.

FIG. 8 is a view illustrating the grid electrode 29 when viewed in the direction indicated by the arrow VIII in FIG. 7.

As illustrated in FIG. 8, the grid electrode 29 includes a first region 291 that has plural through holes 29A and thus is formed in a mesh shape.

In addition, as illustrated in FIG. 8, a second region 292 is provided closer to the rear end block 3 side (see FIG. 7) than the first region 291. The second region 292 includes no through hole and is a solid plate body. In addition, in the present exemplary embodiment, the boundary between the first region 291 and the second region 292 will be referred to as a boundary 293.

Here, in the present exemplary embodiment, when the grid cleaner 20 (see FIG. 7) passes on the first region 291 represented in FIG. 8, a drag force acting on the grid cleaner 20 is low.

In the present exemplary embodiment, the through holes 29A are formed in the first region 291, and the contact area between the first region 291 and the grid cleaner 20 is small. Hence, when the grid cleaner 20 passes on the first region 291, the drag force acting on the grid cleaner 20 is low.

In contrast, when the grid cleaner 20 passes on the second region 292 of the grid electrode 29, the drag force acting on the grid cleaner 20 is high.

No through hole is formed in the second region 292, and the contact area between the second region 292 and the grid cleaner 20 is large.

As a result, the drag force acting on the grid cleaner 20 when the grid cleaner 20 passes on the second region 292 is larger than the drag force acting on the grid cleaner 20 when the grid cleaner 20 passes on the first region 291.

Figure 9:
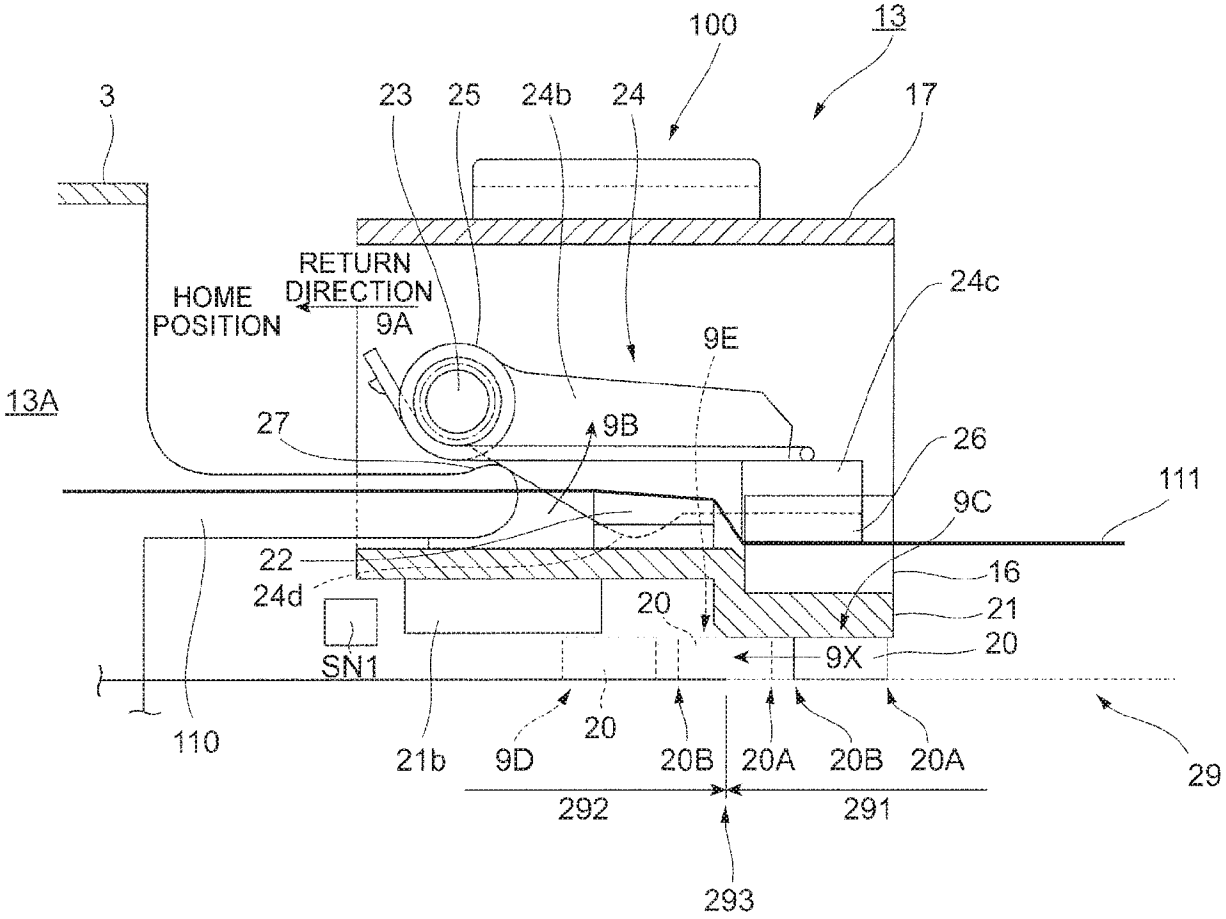
FIG. 9 is a view illustrating the movable body when the movable body returns to a home position.

FIG. 9 is a view illustrating the movable body 100 when the movable body 100 returns to the home position.

When the movable body 100 returns to the home position, the movable body 100 moves in one direction indicated by the arrow 9A in FIG. 9 (hereinafter, the one direction will be referred to as a "return direction").

When the movable body 100 moves in the return direction, the grid cleaner 20, which is located in the first region 291 of the grid electrode 29, moves to the second region 292, which is located downstream in comparison with the first region 291 in the return direction, as indicated by the arrow 9X in FIG. 9.

Further, when the movable body 100 moves in the return direction, as illustrated in FIG. 9, the upper cleaner support body 24, which is provided in the movable body 100, comes into contact with the tip end of the block protrusion portion 110 provided at the main body 13A side of the charging device 13.

Therefore, in the present exemplary embodiment, the movable body 100 receives the driving force from the main body 13A side, and separates the upper wire cleaner 26 from the wire electrode 111 by using the driving force.

More specifically, in the present exemplary embodiment, when the upper cleaner support body 24 comes into contact with the tip end of the block protrusion portion 110, the upper cleaner support body 24 receives the driving force and rotates counterclockwise as indicated by the arrow 9B in FIG. 9.

When the upper cleaner support body 24 rotates counterclockwise, the upper wire cleaner 26, which is provided at the tip end of the upper cleaner support body 24, is separated from the wire electrode 111.

When the upper wire cleaner 26 is separated from the wire electrode 111, the wire electrode 111 is displaced (toward the shaft portion 23 side), and as a result, the wire electrode 111 is separated from the lower electrode cleaner 16 and the lower wire cleaner 22.

Here, in the present exemplary embodiment, when the movable body 100 comes into contact with the tip end of the block protrusion portion 110, the grid cleaner 20 is located in the first region 291 of the grid electrode 29 as indicated by the reference numeral 9C in FIG. 9.

Additionally, when the movable body 100 comes into contact with the tip end of the block protrusion portion 110, the grid cleaner 20 is not located in the second region 292, but is located in the first region 291 located upstream in comparison with the second region 292 (upstream in the return direction).

In other words, in the present exemplary embodiment, the movable body 100 comes into contact with the block protrusion portion 110 at the main body 13A side of the charging device 13 before the grid cleaner 20 reaches the second region 292 of the grid electrode 29.

For further explanation, in the present exemplary embodiment, the movable body 100 comes into contact with the block protrusion portion 110 before an upstream end portion 20A and a downstream end portion 20B of the grid cleaner 20 reach the second region 292 of the grid electrode 29.

The grid cleaner 20 of the present exemplary embodiment includes the upstream end portion 20A at the upstream side thereof in the return direction, and the downstream end portion 20B at the downstream side thereof in the return direction. When the movable body 100 moves in the return direction, the movable body 100 moves so that the downstream end portion 20B serves as a leading portion and the upstream end portion 20A comes after the downstream end portion 20B.

In the present exemplary embodiment, the movable body 100 comes into contact with the block protrusion portion 110 before the upstream end portion 20A and the downstream end portion 20B reach the second region 292 of the grid electrode 29.

Here, in a case where the movable body 100 comes into contact with the block protrusion portion 110 in the state in which the grid cleaner 20 has reached the second region 292 of the grid electrode 29 as indicated by the dashed line 9D in FIG. 9, a load acting on the movable body 100 rapidly increases at the moment when the movable body 100 comes into contact with the block protrusion portion 110. In this case, the movable body 100 may be difficult to move or may be stopped.

In contrast, in the configuration of the present exemplary embodiment, the grid cleaner 20 does not reach the second region 292 when the movable body 100 comes into contact with the block protrusion portion 110, and the load acting on the movable body 100 is low.

Descriptions have been made above regarding the case where the movable body 100 comes into contact with the block protrusion portion 110 before both the upstream end portion 20A and the downstream end portion 20B reach the second region 292 of the grid electrode 29.

However, the configuration is an example, and as indicated by the reference numeral 9E in FIG. 9, in a case where the upstream end portion 20A does not reach the second region 292 even in a state in which the downstream end portion 20B has reached the second region 292, the load acting on the movable body 100 is low when the movable body 100 comes into contact with the block protrusion portion 110.

In other words, the load acting on the movable body 100 is reduced as compared to the case where the movable body 100 comes into contact with the block protrusion portion 110 in a state in which both the downstream end portion 20B and the upstream end portion 20A have reached the second region 292.

Figure 10:
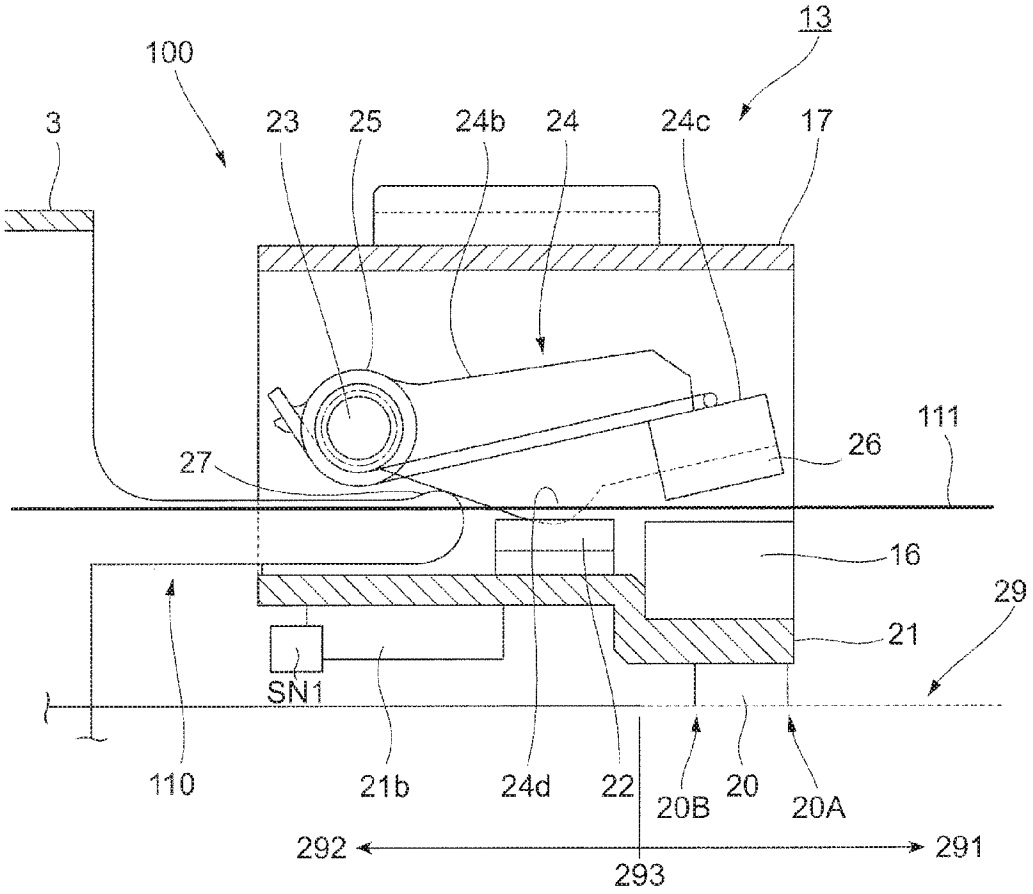
FIG. 10 is a view illustrating another exemplary configuration of the charging device.

As illustrated in FIG. 10 (illustrating another exemplary configuration of the charging device), there may be a configuration in which the upper wire cleaner 26 is separated from the wire electrode 111 before the upstream end portion 20A and the downstream end portion 20B reach the second region 292 of the grid electrode 29.

The load acting on the movable body 100 increases in the case where the grid cleaner 20 has reached the second region 292. However, in this case, when the upper wire cleaner 26 is spaced apart from the wire electrode 111, the load acting on the movable body 100 is reduced, and the movable body 100 moves more smoothly.

In addition, there may be a configuration in which the upper wire cleaner 26 is separated from the wire electrode 111 in the state in which the downstream end portion 20B has reached the second region 292, and the upstream end portion 20A has not yet reached the second region 292, as described above.

Although not illustrated, there may be a configuration in which the plate protrusion portion 24*d* (see FIG. 10) climbs over the upper protrusion portion 27 of the block protrusion portion 110 before the upstream end portion 20A and the downstream end portion 20B reach the second region 292 of the grid electrode 29.

In the configuration in which the plate protrusion portion 24*d* climbs over the upper protrusion portion 27 in the state in which the grid cleaner 20 (the upstream end portion 20A and the downstream end portion 20B thereof) have reached the second region 292, the movable body 100 may be difficult to move or may be stopped when the plate protrusion portion 24*d* climbs over the upper protrusion portion 27.

In the configuration in which the plate protrusion portion 24*d* climbs over the upper protrusion portion 27 before both the upstream end portion 20A and the downstream end portion 20B of the grid cleaner 20 reach the second region 292, the load acting on the movable body 100 is reduced, and the movable body 100 becomes easy to move.

In addition, there may be a configuration in which the plate protrusion portion 24*d* climbs over the upper protrusion portion 27 in the state in which the downstream end portion 20B has reached the second region 292, and the upstream end portion 20A has not yet reached the second region 292, as described above.

Figure 11:
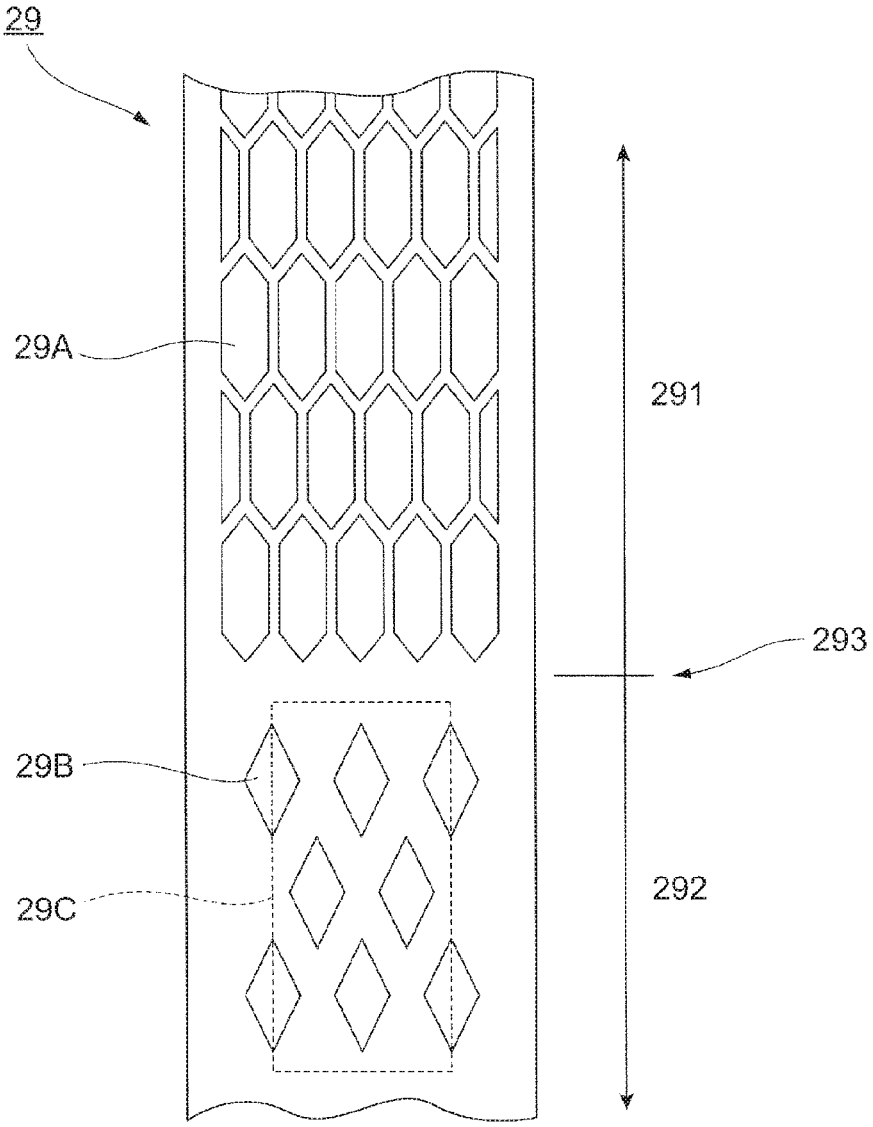
FIG. 11 is a view illustrating another exemplary configuration of the grid electrode.

In addition, the second region 292 configured with a solid plate body has been described above as an example, but through holes 29B may also be formed in the second region 292 as illustrated in FIG. 11 (illustrating another exemplary configuration of the grid electrode 29).

Here, in the exemplary configuration illustrated in FIG. 11, plural rhombic through holes 29B is formed in the second region 292. In addition, in this example, when comparing proportions of through holes performed per unit area (comparing the proportions based on a total area of through holes formed per unit area), a proportion of the through holes 29B formed in the second region 292 is smaller than a proportion of the through holes 29A formed in the first region 291.

In the case where the through holes 29B are formed in the second region 292, the contact area between the grid cleaner 20 and the second region 292 is decreased, as compared to the case where the second region 292 is a solid plate (no through hole 29B is formed in the second region 292).

In this case, when the grid cleaner 20 moves over the second region 292, the load acting on the movable body 100 is reduced.

A single large through hole may be formed in the second region 292 as indicated by the dashed line 29C in FIG. 11, but in this case, the grid electrode 29 is easily deformed. In particular, in the present exemplary embodiment, the tension force is applied to the grid electrode 29, and the grid electrode 29 is easily deformed. When the grid electrode 29 is deformed, the deformation affects the charging performance.

For this reason, it is preferable to ensure the rigidity of the second region 292 by providing plural through holes 29B in the second region 292, rather than a single large through hole.

In addition, a shape of each of the plural through holes 29B provided in the second region 292 is not limited to the rhombic shape, and may be other shapes such as a rectangular, square, triangular, circular, or elliptical shape.

Figure 12:
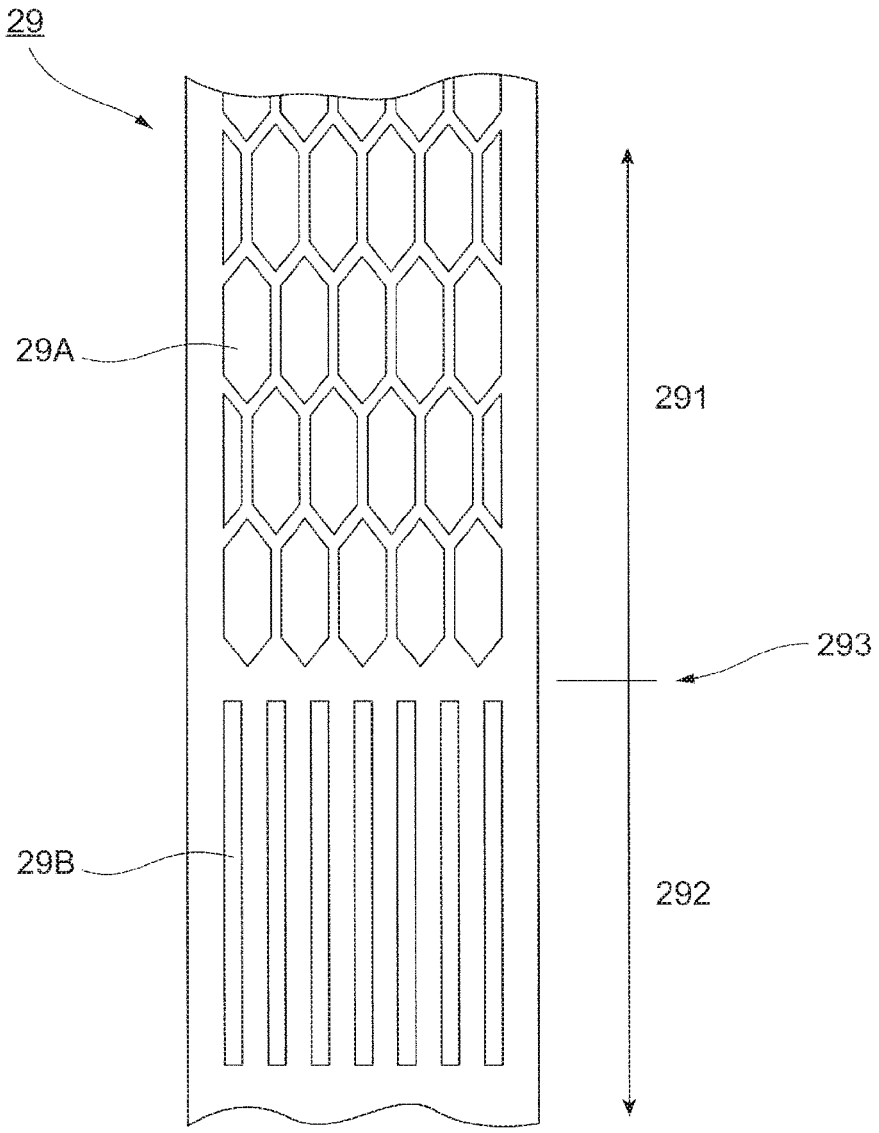
FIG. 12 is a view illustrating another exemplary configuration of the grid electrode.

In addition, as illustrated in FIG. 12 (illustrating another exemplary configuration of the grid electrode 29), plural through holes 29B each elongated along, for example, the longitudinal direction of the grid electrode 29 may be provided in the second region 292. In addition, in the exemplary configuration illustrated in FIG. 12, the plural through holes 29B is arranged side by side in the short-length direction of the grid electrode 29.

(Others)

While the color image forming apparatus has been described above as an example, the above-described respective configurations may be applied to a monochromic image forming apparatus. In addition, while the tandem type image forming apparatus has been described above as an example, the above-described respective configurations may be applied to a rotary type image forming apparatus.

In addition, in the above descriptions, the movable body 100 is caused to move by using the shaft 6 including the spiral protrusion portion 6*a*. However, the movable body 100 may be caused to move by using other known mechanisms.

In addition, the inner surface of the shield electrode 2 may be cleaned by providing a cleaning member which comes into contact with the inner surface of the shield electrode 2. In addition, both the surfaces of the grid electrode 29 may be cleaned by providing a cleaning member which comes into contact with the lower surface of the grid electrode 29.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a first cleaning member configured to move in one direction;

a first electrode configured to be cleaned by the first cleaning member moving in the one direction;

a second cleaning member configured to move in the one direction together with the first cleaning member and move so that a downstream end portion thereof, which is located downstream in the one direction, serves as a leading portion and an upstream end portion thereof comes after the downstream end portion;

a second electrode comprising:

a first region configured to be cleaned by the second cleaning member moving in the one direction; and a second region that is located downstream in comparison with the first region in the one direction and is configured to apply, to the second cleaning member, a drag force higher than a drag force acting on the second cleaning member when the second cleaning member passes on the first region; and a movable body to which the first cleaning member and the second cleaning member are attached, the movable body configured to move in the one direction to come into contact with a predetermined position before the upstream end portion of the second cleaning member reaches the second region so as to receive a driving force from the predetermined position and separate the first cleaning member from the first electrode by using the driving force, wherein a plurality of through holes is formed in the second region of the second electrode.

2. The charging device according to claim 1, wherein the movable body is configured to come into contact with the predetermined position before the downstream end portion of the second cleaning member moving in the one direction reaches the second region.

3. An image forming apparatus comprising:

an image carrier;

a charging device according to claim 1, configured to charge the image carrier;

an exposure device configured to expose the image carrier charged by the charging device and form an electrostatic latent image on the image carrier; and an image developing device configured to develop the electrostatic latent image formed by the exposure device.

4. A charging device comprising:

a first cleaning member configured to move in one direction;

a first electrode configured to be cleaned by the first cleaning member moving in the one direction;

a second cleaning member configured to move in the one direction together with the first cleaning member, and move so that a downstream end portion thereof, which is located downstream in the one direction, serves as a leading portion and an upstream end portion thereof comes after the downstream end portion;

a second electrode comprising:

a first region configured to be cleaned by the second cleaning member that is moving in the one direction and includes a plurality of through holes; and a second region that is located downstream in comparison with the first region in the one direction and includes no through hole or includes through holes with a smaller proportion per unit area than that in the first region; and a movable body to which the first cleaning member and the second cleaning member are attached, the movable body configured to move in the one direction to come into contact with a predetermined position before the upstream end portion of the second cleaning member reaches the second region so as to receive a driving force from the predetermined position and separate the first cleaning member from the first electrode by using the driving force, wherein a plurality of through holes is provided in the second region.

5. The charging device according to claim 4, wherein the movable body is configured to come into contact with the predetermined position before the downstream end portion of the second cleaning member moving in the one direction reaches the second region.

6. An image forming apparatus comprising:

an image carrier;

a charging device according to claim 4, configured to charge the image carrier;

an exposure device configured to expose the image carrier charged by the charging device and form an electrostatic latent image on the image carrier; and an image developing device configured to develop the electrostatic latent image formed by the exposure device.

* * * * *